US007752792B2

(12) United States Patent
Hsieh et al.

(10) Patent No.: US 7,752,792 B2
(45) Date of Patent: Jul. 13, 2010

(54) BILLBOARD WITH LIGHT EMITTING DIODE LIGHT SOURCE

(75) Inventors: Shu-Hui Hsieh, Miao-Li Hsien (TW); Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 92 days.

(21) Appl. No.: 12/135,861

(22) Filed: Jun. 9, 2008

(65) Prior Publication Data

US 2009/0077847 A1 Mar. 26, 2009

(30) Foreign Application Priority Data

Sep. 21, 2007 (CN) ..... 2007 1 0201797

(51) Int. Cl.
*G09F 13/04* (2006.01)

(52) U.S. Cl. ..... 40/546; 362/612; 362/616

(58) Field of Classification Search ..... 40/541, 40/542, 564, 570, 581; 362/600, 608, 610–613
See application file for complete search history.

(56) References Cited

U.S. PATENT DOCUMENTS

| | | | | |
|---|---|---|---|---|
| 5,161,873 | A * | 11/1992 | Obata | 362/613 |
| 5,688,042 | A * | 11/1997 | Madadi et al. | 362/240 |
| 6,167,648 | B1 * | 1/2001 | Dimmick | 40/564 |
| 7,150,117 | B2 * | 12/2006 | Venegas, Jr. | 40/580 |
| 7,352,339 | B2 * | 4/2008 | Morgan et al. | 345/31 |
| 7,354,180 | B2 * | 4/2008 | Sawhney et al. | 362/388 |
| 7,481,563 | B2 * | 1/2009 | David et al. | 362/612 |
| 7,549,245 | B2 * | 6/2009 | Ter-Hovhannissian | 40/546 |
| 7,588,364 | B2 * | 9/2009 | Kitamura et al. | 362/616 |
| 2007/0165419 | A1 * | 7/2007 | Horiuchi et al. | 362/606 |

FOREIGN PATENT DOCUMENTS

| | | | |
|---|---|---|---|
| CN | 2849887 | Y | 12/2006 |
| CN | 101038399 | A | 9/2007 |
| EP | 1615419 | A1 | 1/2006 |
| JP | 2005-93256 | A | 4/2005 |

OTHER PUBLICATIONS

Michael S. Shur et al., Solid-State Lighting: Toward Superior Illumination, Proceedings of the IEEE, 1691-1703, vol. 93, No. 10, Oct. 2005.

* cited by examiner

*Primary Examiner*—Lesley Morris
*Assistant Examiner*—Shin Kim
(74) *Attorney, Agent, or Firm*—Andrew C. Cheng

(57) ABSTRACT

A billboard (100) includes a light module (120) and a light-permeable panel (140). The light module comprises a plurality of elongated light conductors (122) and at least one LED (124). Each of the light conductors has two end surfaces (1222, 1224) and a circumferential lateral surface (1223) interconnected between the end surfaces, and one of the end surfaces of each of the light conductors is adjacent to and optically coupled to the at least one LED. The light-permeable panel has a light incident surface (142) and an opposite light emitting surface (144). One of the light incident surface and the light emitting surface has a pattern (143).

19 Claims, 8 Drawing Sheets

BILLBOARD WITH LIGHT EMITTING DIODE LIGHT SOURCE

BACKGROUND OF THE INVENTION

1. Field of the Invention

The present invention relates to an electronic display, and particularly to a luminous billboard using a light emitting diode as a light source.

2. Description of Related Art

Billboards can be divided into non-luminous billboards or luminous billboards. The non-luminous billboards without light source cannot provide a visual advertisement at night or darksome environment. The conventional luminous billboards make use of cold cathode fluorescent lamp (CCFL) as light source. However, the CCFL has many disadvantages such as large volume, low light efficiency, short life span and polluted to the environment so that the CCFL can not be widely used in billboards.

Light emitting diodes (LEDs), on the other hand, have many advantages, such as high luminance, low power consumption, highly compatible with integrated circuits, long-term reliability, environmental friendliness and are becoming widely used as light source, as described in an article entitled "Solid-State Lighting: Toward Superior Illumination" cited in a publication of Proceedings of the IEEE, Vol. 93, No. 10, October, 2005 authored by Michael S. Shur.

Accordingly, what is desired, therefore, is a billboard using LED as light source with a compact size, environment friendliness and long-term reliability.

SUMMARY

In accordance with a preferred embodiment, a billboard using LED as light source includes a light module and a light-permeable panel. The light module comprises a plurality of elongated light conductors and at least one LED. Each of the light conductors has two end surfaces and a circumferential lateral surface interconnected between the end surfaces, and one of the end surfaces of each of the light conductors is adjacent to the LED and optically coupled to the at least one LED. The light-permeable panel has a light incident surface and an opposite light emitting surface, one of the light incident surface and the light emitting surface has a pattern.

Other advantages and novel features of the present invention will become more apparent from the following detailed description of preferred embodiment when taken in conjunction with the accompanying drawings.

DETAILED DESCRIPTION

Figure 1:
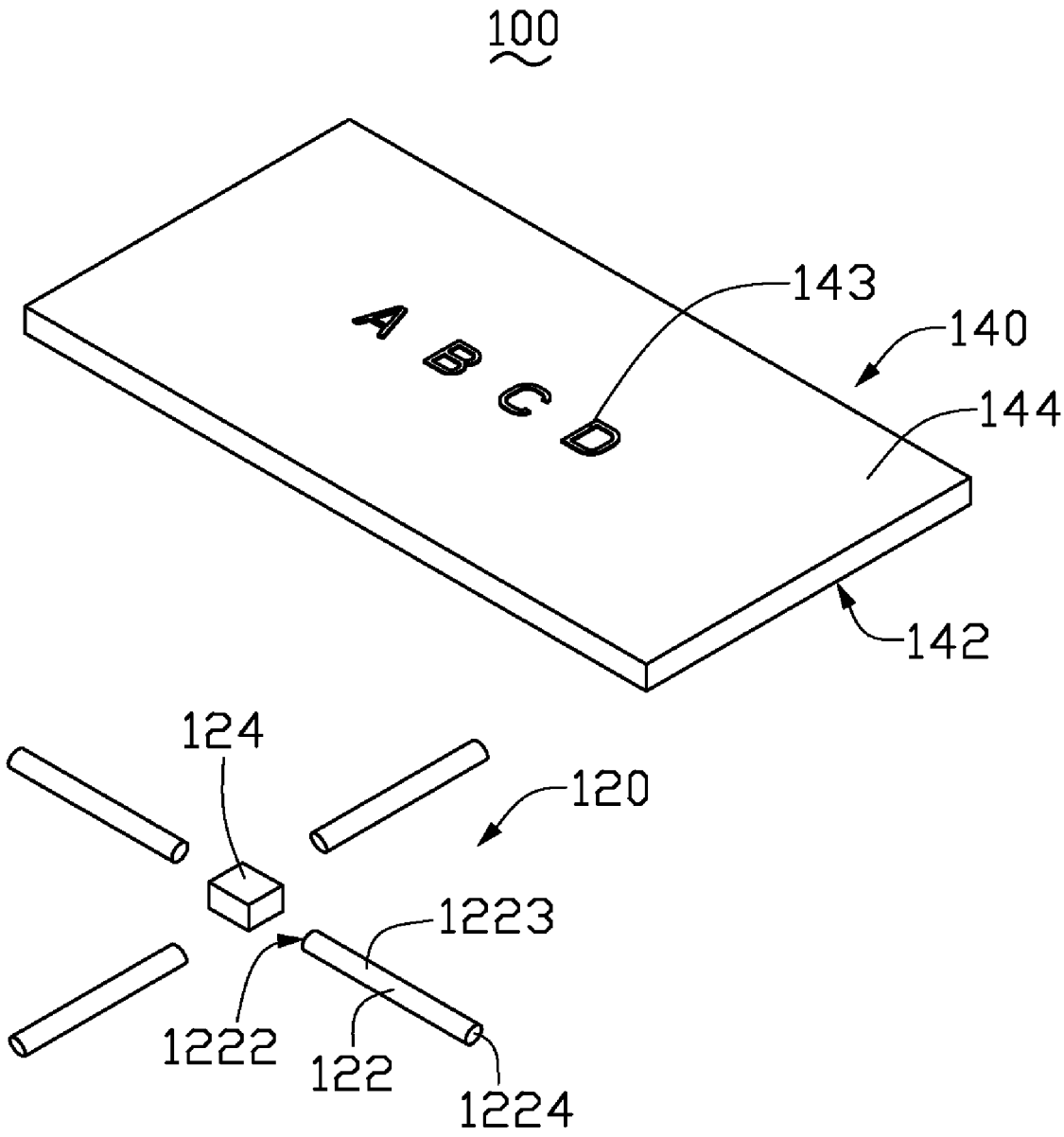
FIG. 1 is an explored, isometric view of a billboard in accordance with a preferred embodiment of the present invention.
Figure 2:
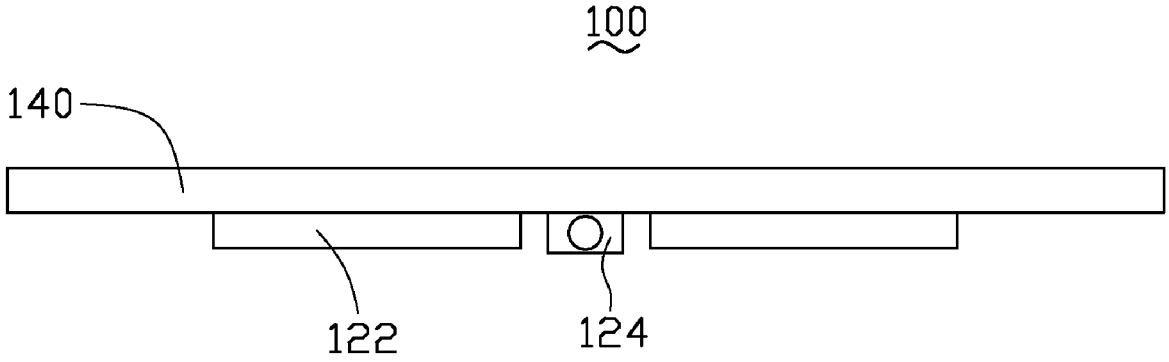
FIG. 2 is a right side view of an assembly of the billboard shown in FIG. 1.

Referring to FIG. 1 and FIG. 2, a billboard 100 in accordance with a first embodiment comprises a light module 120 and a light-permeable panel 140. The light module 120 comprises an LED 124 and a plurality of cylindrical light conductors 122 disposed around the LED 124. The LED 124 can provide white light.

Each of the light conductors 122 has two end surfaces 1222, 1224 and a circumferential lateral surface 1223 between the two end surfaces 1222, 1224. The end surface 1222 of the light conductor 122 is adjacent to the LED 124 for forming optics coupling. Light emitted from the LED 124 can enter the light conductor 122 via the end surface 1222. Then the light transmits through the light conductor 122 and at last emits out of the light conductor 122 through the lateral surface 1223 in form of a line so that each light conductor 122 can be used as a line light source. Four light conductors 122 cooperatively provide light for covering a surface which is desired to be illuminated. As shown in FIG. 1, the LED 124 emits light from lateral surfaces thereof. The light conductors 122 each correspond to the lateral surfaces of the LED 124 and form a radial arrangement. The light conductors 122 and the LED 124 are arranged at a same surface. Such an arrangement can make full use of light of the LED 124 so that light efficiency of the LED 124 is improved and cost is reduced. A profile of the LED 124 is not limited to cylindrical, which can also be rectangular or elliptic. The light conductor 122 can be made of a transparent material selected from a group consisting of resin, silica gel or plastic material. Visible light can transmit through the light conductor 122.

The LED 124 can comprise at least an LED chip, such as a blue LED chip that can emit blue light. The blue light can be turned into white light via yellow fluorescent powder or a combination of green fluorescent powder and red fluorescent powder. It is to be understood that the white light can be made by mixing red light, green light and blue light so that the fluorescent powder can be saved. The LED 124 preferably uses side-emitting LED.

It is to be understood that the number of the light conductors 122 is not limited to four, the number of the LED 124 is not limited to one. The number of the light conductors 122 or the LED 124 is determined according to requirement in application, such as light uniformity, brightness of the light module 120 being provided for the billboard 100. For example, four LEDs 124 are disposed to form a rectangular arrangement to provide white light for four corresponding light conductors 122 respectively. Furthermore, in the arrangement configured by more than one LEDs 124, the end surface 1224 of the light conductor 122 can also be used to receive light.

The light-permeable panel 140 can be made of a transparent material, for example semitransparent canvas or transparent resin. The light-permeable panel 140 can be made into a rectangular board as shown in FIG. 1 or a flake. The light-permeable panel 140 has a light incident surface 142 and an opposite light emitting surface 144. A pattern 143 shown as ABCD in FIG. 1 is defined in the light emitting surface 144. The light incident surface 142 is used to receive white light from the light module 120. The light emitting surface 144 is used to display the light sent to the light-permeable panel 140 so as to illuminate the pattern 143. The pattern 143 can be defined in the light emitting surface 144 by means of daubing or printing. The pattern 143 can be selected from a group consisting of character, figure, logo et al, which can show an advertisement information. It is to be understood that the pattern 143 can also be defined in the light incident surface 142. Furthermore, the pattern 143 can be colorized as long as light can transmit through the pattern 143. The colorized pattern 143 can filtrate some light having a same color with the pattern 143 in middle of the white light from the light module 120 received by the light incident surface 142 of the light-permeable panel 140.

Figure 3:
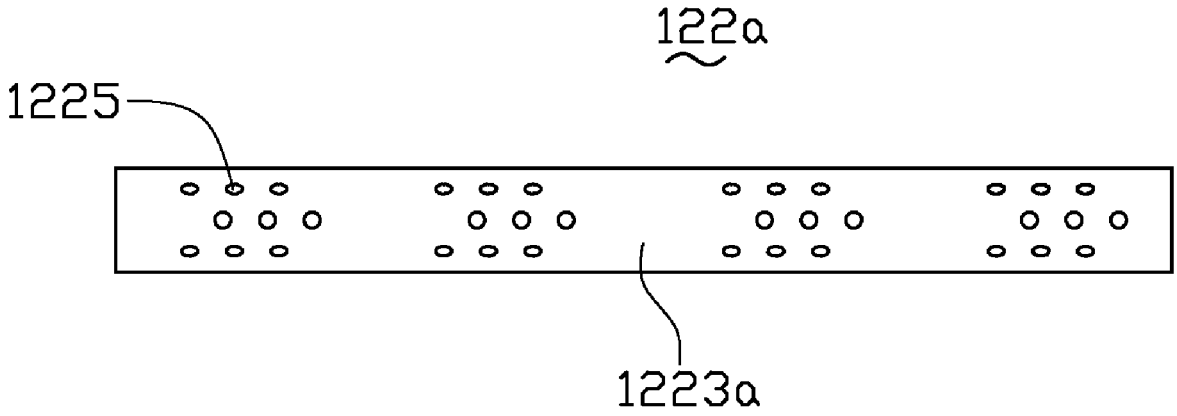
FIG. 3 is a top plan view of a second cylindrical light conductor that can be used in the billboard shown in FIG. 1.

FIG. 3 shows a second light conductor 122*a* which can be used in the light module 120 instead of the light conductor 122. The second light conductor 122*a* has a cylindrical lateral surface 1223*a*. Part of the lateral surface 1223*a* towards the light-permeable panel 140 defines a plurality of micro structure groups 1225 therein. Each of the micro structure groups 1225 comprises a plurality of micro structures constructed as grooves or protrusions. The micro structures of each micro structure group 1225 are discretely defined in the lateral surface 1223*a*. The micro structure groups 1225 are used to eliminate reflection of the light occurring in the lateral surface 1223*a* so that more light in the light conductor 122*a* can be emitted out via the lateral surface 1223*a*. Moreover, in another part of the lateral surface 1223*a* without the micro structure groups 1225, light emitted from the light conductor 122*a* is reduced. It is to be understood that the micro structures 1225 can also be continuously defined in the lateral surface 1223*a*. The micro structures 1225 can be formed by injection or burnishing. As shown in FIG. 3, the micro structure groups 1225 are discretely arranged along a length direction of the light conductor 122.

Figure 4:
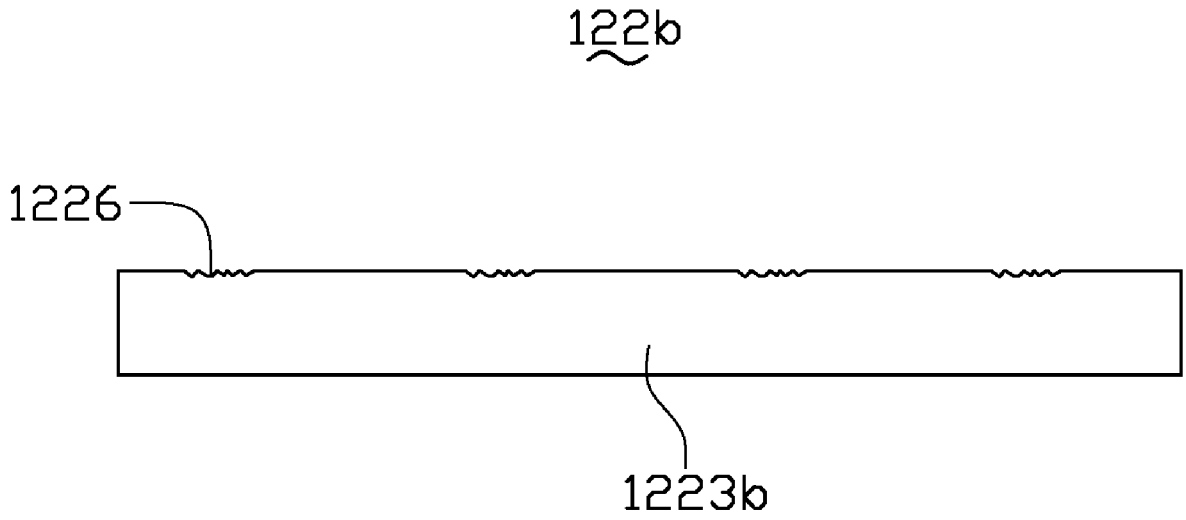
FIG. 4 is a right side view of a third cylindrical light conductor that can be used in the billboard shown in FIG. 1.

FIG. 4 shows a third light conductor 122*b* which can be used in the light module 120 instead of the light conductor 122. The third light conductor 122*b* has a cylindrical lateral surface 1223*b*. A plurality of roughened surfaces 1226 are defined in parts of the lateral surface 1223*b*. The roughened surfaces 1226 towards the light-permeable panel 140 are used to eliminate total reflection of the light occurring in the lateral surface 1223*b* so that more light in the light conductor 122*b* can be emitted via the lateral surface 1223*b*. Moreover, in another part of the lateral surface 1223*b* without the roughened surfaces 1226, light emitted from the light conductor 122*a* is reduced. The roughened surfaces 1226 can be defined by sandblast or polish. As shown in FIG. 4, the roughened surfaces 1226 are discretely arranged along a length direction of the light conductor 122*b*.

Figure 5:
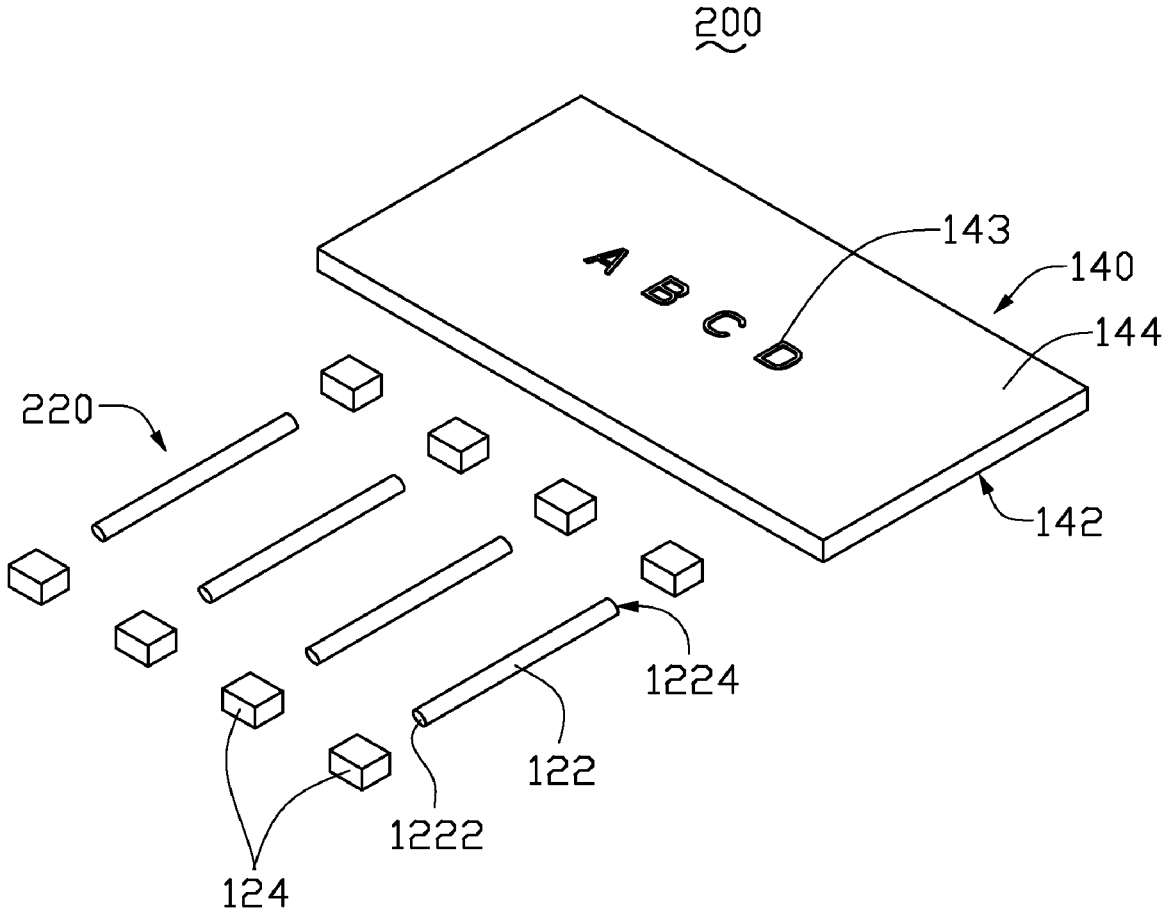
FIG. 5 is an explored, isometric view of a billboard in accordance with a second embodiment of the present invention.

Referring to FIG. 5, a billboard 200 in accordance with a second embodiment of the present invention is shown. The billboard 200 has a similar configuration to the billboard 100. The billboard 200 comprises a light module 220 and a light-permeable panel 140. The difference between the billboard 200 and the billboard 100 is that the light module 220 comprises more than one LEDs 124. Furthermore, arrangement of the LEDs 124 and the light conductors 122 of the light module 220 is different from the light module 120. The light conductors 122 are arranged in parallel and spaced from each other. Corresponding to each light conductor 122, two of the LEDs 124 are respectively disposed towards the two end surfaces 1222, 1224 of the light conductor 122 for forming optics coupling. The light conductors 122 and the LEDs 124 are arranged at a same surface.

Figure 6:
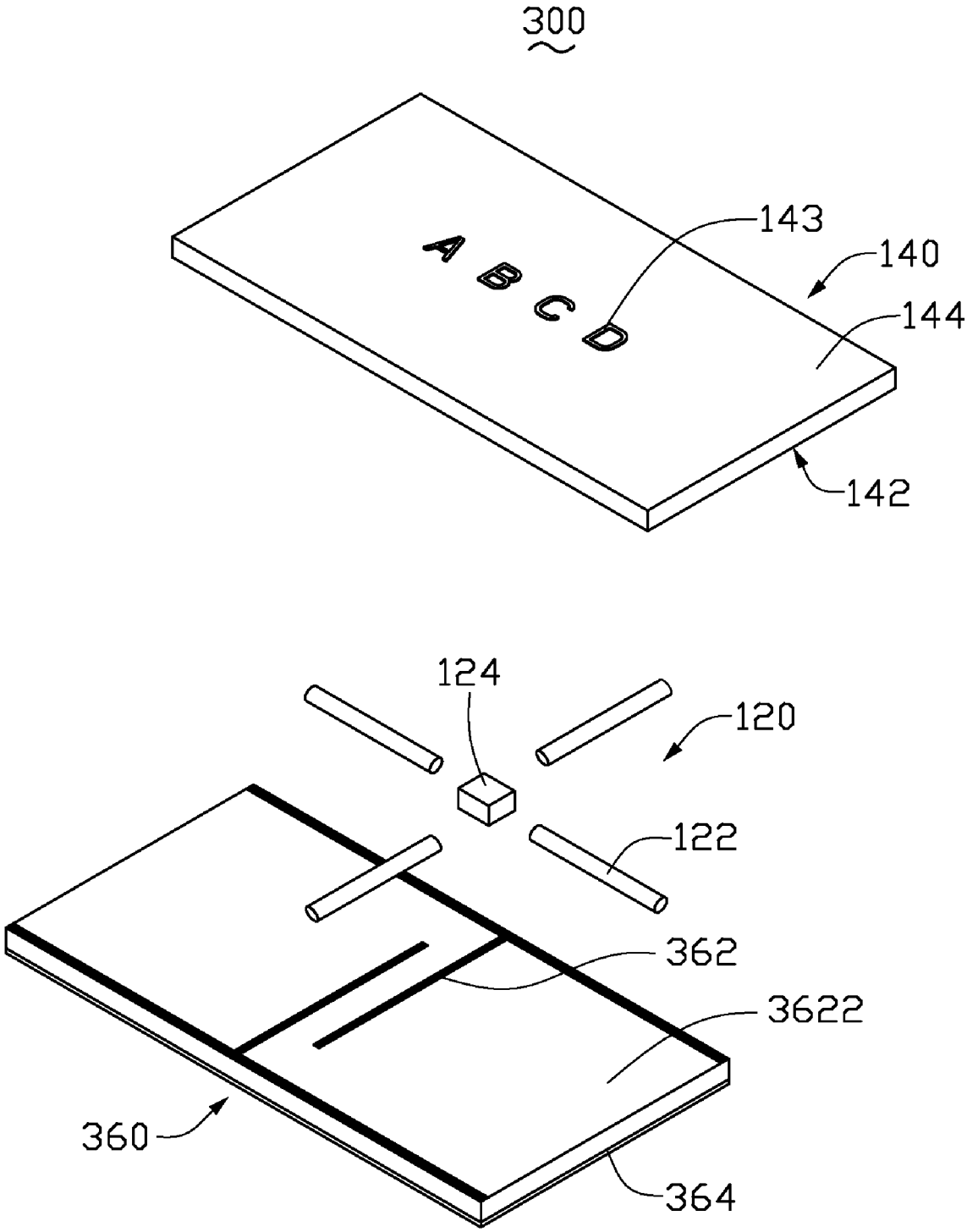
FIG. 6 is an explored, isometric view of a billboard in accordance with a third embodiment of the present invention.
Figure 7:
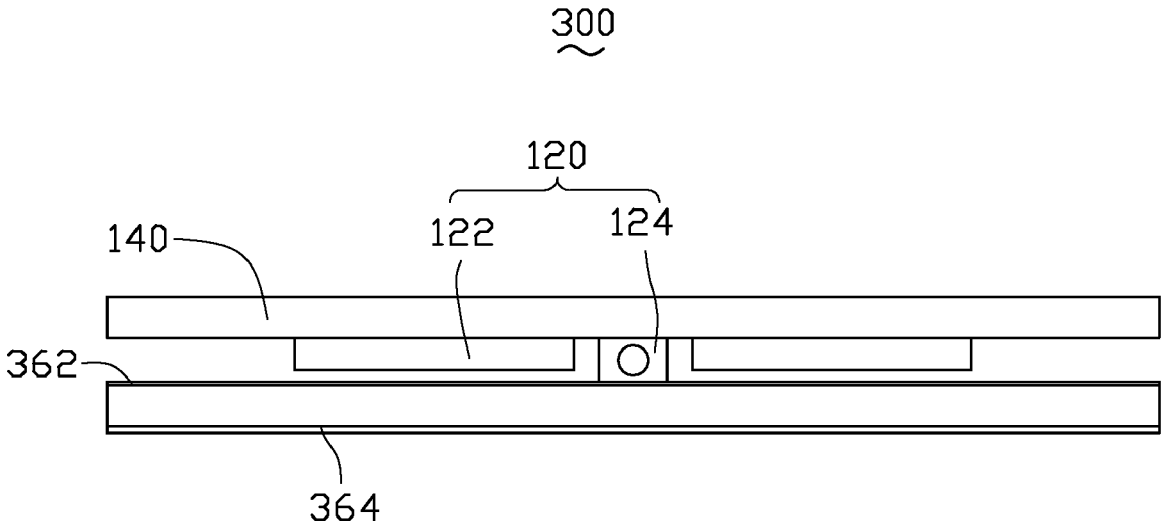
FIG. 7 is a right side view of an assembly of the billboard shown in FIG. 6.

Referring to FIG. 6 and FIG. 7, a billboard 300 in accordance with a third embodiment of the present invention is shown. The billboard 200 has a similar configuration to the billboard 100. The billboard 300 comprises a light module 120 and a light-permeable panel 140 which are the same with the corresponding ones in the billboard 100. The difference between the billboard 300 and the billboard 100 is that the billboard 300 further comprises a flexible reflector 360 disposed under the light module 120. The light module 120 is located between the light-permeable panel 140 and the flexible reflector 360. The flexible reflector 360 has a similar size to the light-permeable panel 140. The flexible reflector 360 has a top surface 3622 and an opposite bottom surface (not labeled). The top surface 3622 has a same dimension with the light incident surface 142. Two spaced wires 362 are disposed on the top surface 3622 and electrically connect with the LED 124 of the light module 120. A reflective layer 364 is attached to a bottom surface of the flexible reflector 360 for reflecting light casting on the bottom surface of the flexible reflector 360 so as to improve efficiency of the light generated from the LED 124 The reflective layer 364 can be made of a material selected from a group consisting of metal such as aluminum, black or white ink, which can reflect visible light. It is to be understood that the reflective layer 364 can also be disposed on the top surface 3622 of the flexible reflector 360. As shown in FIG. 6, the LED 124 is attached to the top surface 3622 as electrically connecting with the wires 362.

Figure 8:
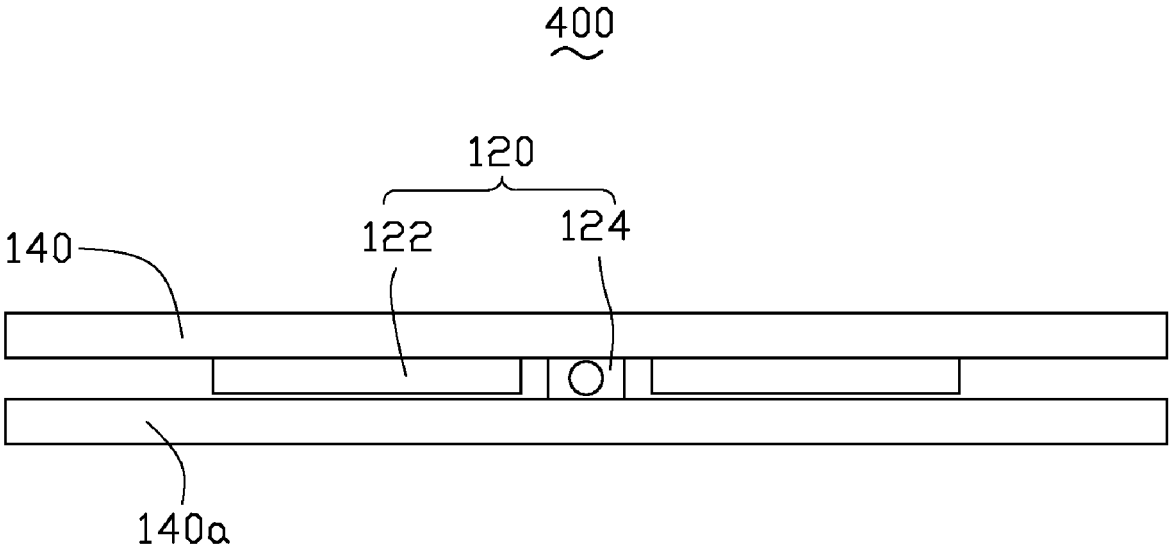
FIG. 8 is a right side view of an assembly of a billboard in accordance with a fourth embodiment of the present invention.

Referring to FIG. 8, a billboard 400 in accordance with a fourth embodiment of the present invention is shown. The billboard 400 has a similar configuration to the billboard 100. The billboard 400 comprises a light module 120 and a first light-permeable panel 140. The difference between the billboard 400 and the billboard 100 is that the billboard 400 further comprises a second light-permeable panel 140*a* arranged below the light module 120. The light-permeable panel 140*a* also has a pattern for display and is attached to a bottom of the LED 124. The light module 120 is between the light-permeable panel 140 and the light-permeable panel 140*a* so that the billboard 400 has display panels on both sides. The light-permeable panel 140*a* can also have a same configuration with the light-permeable panel 140.

It is to be understood that either of the billboards 300, 400 can also use the light module 220 in the second embodiment instead of the light module 120.

It is to be understood that the billboards 100, 200, 300, 400 having the LEDs 124 have many advantages, such as compact size, environment friendliness and long-term reliability. Thus the billboards 100, 200, 300, 400 can be used to provide uniform illumination and clearly display patterns according to need instead of CCFL.

It is to be understood, however, that even though numerous characteristics and advantages of the present billboards 100, 200, 300, 400 have been set forth in the foregoing description, together with details of the structure and function of the preferred embodiments, the disclosure is illustrative only, and changes may be made in detail, especially in matters of shape, size, arrangement of the LEDs 124 and the light conductors 122, 122*a*, 122*b*, within the principles of the invention to the full extent indicated by the broad general meaning of the terms in which the appended claims are expressed.

What is claimed is:

1. A billboard comprising:

a light module comprising a plurality of elongated light conductors, and at least one LED, wherein each of the light conductors has two end surfaces and a circumferential lateral surface interconnected between the end surfaces, and one of the end surfaces of each of the light conductors is adjacent to and optically coupled to the at least one LED; and at least one light-permeable panel comprising a light incident surface and an opposite light emitting surface, one of the light incident surface and the light emitting surface having a pattern.

2. The billboard as described in claim 1, wherein the pattern is a color pattern functioning as a filter for filtering out light having a same color as the color of the color pattern.

3. The billboard as described in claim 1, wherein the light conductors are disposed around the at least one LED.

4. The billboard as described in claim 1, wherein the light conductors are arranged in parallel and spaced from each other.

5. The billboard as described in claim 4, wherein the at least one LED includes a plurality of LEDs, and the LEDs are disposed towards the end surfaces of each of the light conductors.

6. The billboard as described in claim 1, wherein at least one of the light conductors comprises a plurality of micro structures formed on portions of the circumferential lateral surface facing towards the at least one light-permeable panel for minimizing total internal reflection at the circumferential lateral surface.

7. The billboard as described in claim 1, wherein at least one of the light conductors comprises a plurality of roughened surface sections on portions of the circumferential lateral surface facing towards the at least one light-permeable panel.

8. The billboard as described in claim 1, wherein a flexible reflector is disposed under the light module, the flexible reflector comprising two wires for electrically connecting to the at least one LED.

9. The billboard as described in claim 8, wherein the flexible reflector has a first surface and an opposite second surface, the wires arranged on the first surface, a reflective layer formed on the second surface of the flexible reflector.

10. The billboard as described in claim 1, wherein the at least one light-permeable panel includes two light-permeable panels, the light module interposed between the light-permeable panels.

11. A billboard comprising:

a light module comprising at least one side-emitting LED and a plurality of light conductors disposed at lateral sides of the side-emitting LED; and a light-permeable panel disposed at a side of the light module, the light-permeable panel having a pattern, wherein each of the light conductors has two end surfaces and a circumferential lateral surface between the two end surfaces, one end surface of each of the light conductors is adjacent to and optically coupled to one of the lateral sides of the side-emitting LED.

12. The billboard using LED as light source as described in claim 11, wherein the light conductor is elongated, the number of the light conductors is four, and the four light conductors are disposed around the at least one LED and towards the lateral sides of the at least one LED.

13. The billboard as described in claim 11, wherein the at least one LED includes a plurality of LEDs, the light conductors are arranged in parallel and spaced from each other, and the LEDs are disposed towards the end surfaces of each of the light conductors.

14. The billboard as described in claim 11, wherein the at least one LED and the conductors are arranged at a same surface.

15. The billboard as described in claim 11, wherein the light-permeable panel comprises a light incident surface and an opposite light emitting surface, the light incident surface is adjacent to the light module, and one of the light incident surface and the light emitting surface has the pattern.

16. The billboard as described in claim 11, wherein at least one of the light conductors comprises a plurality of micro structures or roughened surface sections formed on portions of the circumferential lateral surface facing towards the at least one light-permeable panel for minimizing total internal reflection at the circumferential lateral surface.

17. The billboard as described in claim 11, wherein a flexible reflector is disposed under the light module, the flexible reflector comprising two wires for electrically connecting to the at least one LED.

18. The billboard as described in claim 17, wherein the flexible reflector has a first surface and an opposite second surface, the wires arranged on the first surface, a reflective layer formed on the second surface of the flexible reflector.

19. The billboard as described in claim 11, wherein the at least one light-permeable panel includes two light-permeable panels, the light module interposed between the light-permeable panels.

* * * * *